US012408727B2

(12) United States Patent
Ishikawa et al.

(10) Patent No.: US 12,408,727 B2
(45) Date of Patent: Sep. 9, 2025

(54) SHOE

(71) Applicant: ASICS CORPORATION, Kobe (JP)

(72) Inventors: Tatsuya Ishikawa, Kobe (JP); Koji Otobe, Kobe (JP); Seiji Yano, Kobe (JP); Takashi Inomata, Kobe (JP); Yasuyuki Takada, Kobe (JP); Tomoichiro Ozaki, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 17/255,959

(22) PCT Filed: Dec. 11, 2018

(86) PCT No.: PCT/JP2018/045501
§ 371 (c)(1),
(2) Date: Dec. 23, 2020

(87) PCT Pub. No.: WO2020/121407
PCT Pub. Date: Jun. 18, 2020

(65) Prior Publication Data

US 2021/0361028 A1 Nov. 25, 2021

(51) Int. Cl.
*A43B 13/14* (2006.01)
*A43B 7/142* (2022.01)
(Continued)

(52) U.S. Cl.
CPC ..... *A43B 13/141* (2013.01); *A43B 7/142* (2013.01); *A43B 7/24* (2013.01); *A43B 13/188* (2013.01)

(58) Field of Classification Search
CPC ..... A43B 13/141; A43B 7/142; A43B 7/24; A43B 13/188; A43B 13/16; A43B 13/127;
(Continued)

(56) References Cited

U.S. PATENT DOCUMENTS 6,199,302 B1 3/2001 Kayano
6,578,290 B1 * 6/2003 Meynard ..... A43B 13/146 36/103
(Continued)

FOREIGN PATENT DOCUMENTS

CN 1842282 A 10/2006
CN 104918509 A 9/2015
(Continued)

OTHER PUBLICATIONS

International Search Report for International Application No. PCT/JP2018/045501, dated Mar. 19, 2019, 4 pp. (w/Translation) [300.01PCT (ISR)].
(Continued)

*Primary Examiner* — Alissa L Hoey
*Assistant Examiner* — Akwokwo Olabisi Redhead
(74) *Attorney, Agent, or Firm* — KONRAD, RAYNES, DAVDA & VICTOR LLP; Alan S. Raynes

(57) ABSTRACT

A shoe 100 includes a twist allowance part 22 and a medial reinforcement member 21 (bend restraining part). The twist allowance part 22 is provided in a medial part of a midfoot portion in a shoe sole 1 serving as a bottom portion and allows medial twisting of the heel side with respect to the toe side. The medial reinforcement member 21 is disposed on the twist allowance part 22 and restrains upward bending of the heel side in the medial part.

20 Claims, 9 Drawing Sheets

(51) Int. Cl.
*A43B 7/24* (2006.01)
*A43B 13/18* (2006.01)

(58) Field of Classification Search
CPC ..... A43B 13/125; A43B 13/12; A43B 13/126; A43B 13/04
USPC ..... 36/148, 44.3 R
See application file for complete search history.

(56) References Cited

U.S. PATENT DOCUMENTS

| | | | | |
|---|---|---|---|---|
| 9,775,402 | B2 * | 10/2017 | Nonogawa | A43B 7/1425 |
| 2003/0009914 | A1 * | 1/2003 | Mitsui | A43B 5/00 36/25 R |
| 2003/0014881 | A1 * | 1/2003 | Hay | A43B 7/141 36/25 R |
| 2006/0137228 | A1 | 6/2006 | Kubo et al. | |
| 2010/0281714 | A1 * | 11/2010 | Carboy | A43B 13/14 36/25 R |
| 2010/0293816 | A1 * | 11/2010 | Truelsen | A43B 13/141 36/30 R |
| 2013/0000146 | A1 * | 1/2013 | Brandstatter | A43B 7/141 36/28 |
| 2014/0325876 | A1 | 11/2014 | Dodge et al. | |
| 2015/0082668 | A1 * | 3/2015 | Nonogawa | A43B 7/144 36/30 R |
| 2015/0290892 | A1 * | 10/2015 | Wan | A43B 13/26 12/142 RS |
| 2016/0338446 | A1 | 11/2016 | Merlo | |
| 2017/0079373 | A1 | 3/2017 | Huard et al. | |
| 2017/0095030 | A1 * | 4/2017 | Brandstätter | A43B 7/148 |
| 2017/0251755 | A1 * | 9/2017 | Meschter | A43B 13/122 |
| 2019/0365048 | A1 * | 12/2019 | Fontaine | A43B 23/027 |
| 2020/0100561 | A1 * | 4/2020 | Montross | B29D 35/142 |
| 2020/0214389 | A1 | 7/2020 | Hatano et al. | |

FOREIGN PATENT DOCUMENTS

| | | | |
|---|---|---|---|
| CN | 106539186 | A | 3/2017 |
| EP | 1795083 | A1 | 6/2007 |
| JP | H0947305 | A | 2/1997 |
| JP | 2005304653 | A | 11/2005 |
| JP | 2006136715 | A | 6/2006 |
| JP | 6396628 | B1 | 9/2018 |
| WO | 2013168256 | A1 | 11/2013 |
| WO | 2014036176 | A1 | 3/2014 |

OTHER PUBLICATIONS

Extended European Search Report for European Application No. 18942742, dated Dec. 13, 2021, 7 pp. [300.01EP (EPSR)].
International Preliminary Report on Patentability dated Jun. 8, 2021 for PCT/JP2018/045501 (including Written Opinion of the Int'l Searching Authority dated Mar. 19, 2019) and translation (12 pages total).
Notice of Reasons for Refusal for Japanese Patent Appl. No. 2020-558840 dated Aug. 26, 2022 and translation (8 pages total).
CN Office Action for No. 201880094526.7 and translation and search (9 pages total).

* cited by examiner

SHOE

TECHNICAL FIELD

The present invention relates to shoes used for sports or the like.

BACKGROUND ART

Shoes used for sports or the like are desired to follow the motion of foot portions of the wearer during walking, running, or exercising, for example, and also firmly support the feet.

Patent Literature 1, for example, discloses a cup-shaped stabilizer used for a shoe. The cup-shaped stabilizer has higher hardness and is divided between a medial instep-side member and a lateral instep-side member in the bottom surface part and the heel-side wall part. The shape of the dividing groove is made to correspond to a load moving route, so that impact received when a load is applied can be absorbed by means of deformation of the bottom surface part and the midsole.

Also, Patent Literature 2 discloses a shoe sole comprising an outer sole and a midsole. The midsole includes a lower midsole and an upper midsole formed of resin foam. The lower midsole is formed integrally with a lateral roll-up portion for supporting the lateral side of a foot from a side of the foot. Hardness of a lateral portion of the lower midsole including the lateral roll-up portion is defined as first hardness. Hardness of a medial portion of the lower midsole is defined as second hardness, which is lower than the first hardness. Also, hardness of a lateral portion of the upper midsole is defined as third hardness, which is also lower than the first hardness. Part of or the whole of the lateral roll-up portion having higher hardness protrudes upward to be higher than the upper midsole, on the lateral side of the upper midsole.

RELATED ART DOCUMENT

Patent Literature

Patent Literature 1: Japanese Unexamined Patent Application Publication No. 09-47305
Patent Literature 2: WO 2013/168256

SUMMARY OF THE INVENTION

Problem to be Solved by the Invention

Meanwhile, when a person makes a turning motion, in which the person moves the body to one of left and right sides and then quickly returns to the original position, the person may be in a posture of supporting the weight shift to the side while the vicinity of the thenar eminence of the foot extending to the side is in contact with the ground and the heel is raised. In such a turning motion, the foot is placed in a state where a portion positioned rearward of the thenar eminence is medially twisted with respect to the toe side.

The cup-shaped stabilizer described in Patent Literature 1 includes the medial instep-side member having higher hardness, which could be a resistance factor to the medial twisting of the portion positioned rearward of the thenar eminence. Accordingly, the cup-shaped stabilizer is considered unsuitable for shoes required to have capability to follow twisting of a foot during a turning motion.

Also, with regard to the shoe sole described in Patent Literature 2, although the medial portion is lower in hardness than the lateral portion in the lower midsole, the relationship between the hardness of the medial portion of the lower midsole and the hardness of the medial portion of the upper midsole disposed thereon is unclear. If the hardness of the medial portions of the lower midsole and the upper midsole is low, force cannot be sufficiently transmitted to the ground beneath the thenar eminence during a turning motion.

The present invention has been made in view of such issues, and a purpose thereof is to provide a shoe having favorable capability to follow twisting of a foot during a turning motion.

Means to Solve the Problem

An embodiment of the present invention relates to a shoe. The shoe includes a twist allowance part that is provided in a medial part of a midfoot portion in a bottom portion and that allows medial twisting of a heel side with respect to a toe side, and a bend restraining part that is disposed on the twist allowance part and that restrains upward bending of the heel side in the medial part.

Optional combinations of the aforementioned constituting elements, and implementation of the present invention, including the constituting elements and expressions, in the form of methods or apparatuses may also be practiced as additional modes of the present invention.

Effect of the Invention

The present invention improves capability to follow twisting of a foot during a turning motion.

MODE FOR CARRYING OUT THE INVENTION

Figure 1:
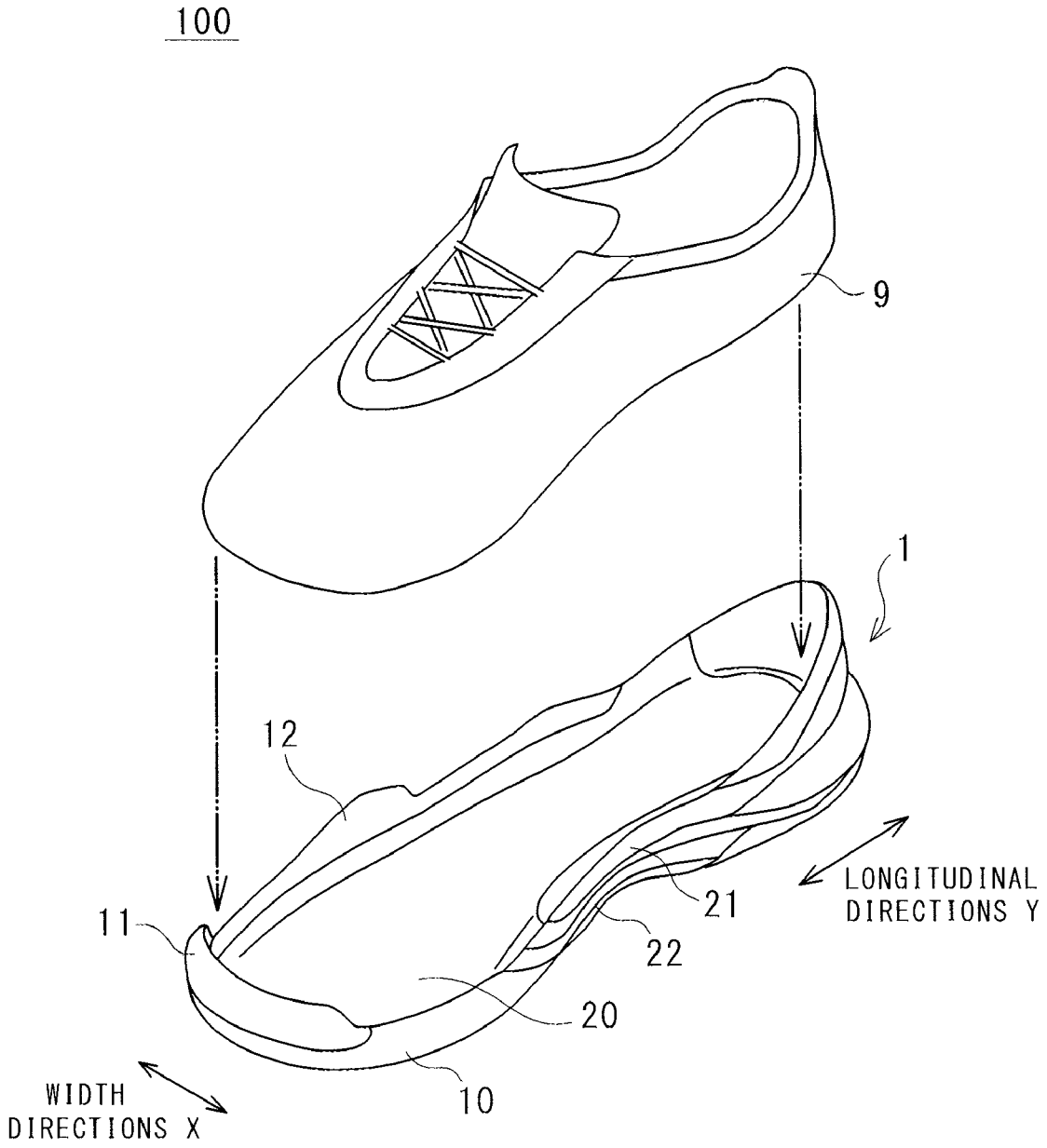
FIG. 1 is an exploded perspective view that illustrates an external view of a shoe according to a first embodiment.

In the following, the present invention will be described based on a preferred embodiment with reference to FIGS. 1 through 12. Like reference characters denote like or corresponding constituting elements and members in each drawing, and repetitive description will be omitted as appropriate. Also, the dimensions of a member may be appropriately enlarged or reduced in each drawing in order to facilitate understanding. Further, in each drawing, part of a member less important in describing an embodiment may be omitted.

First Embodiment

FIG. 1 is an exploded perspective view that illustrates an external view of a shoe 100 according to a first embodiment. The shoe 100 includes an upper 9 and a shoe sole 1. The upper 9 is bonded to or sewed onto a circumferential edge part of the shoe sole 1 to cover the upper side of a foot. The shoe sole 1 includes an outer sole 10 and a midsole 20, for example, and is configured by laminating the midsole 20 on the outer sole 10 and further laminating an insole or the like, not illustrated, thereon.

Figure 2:
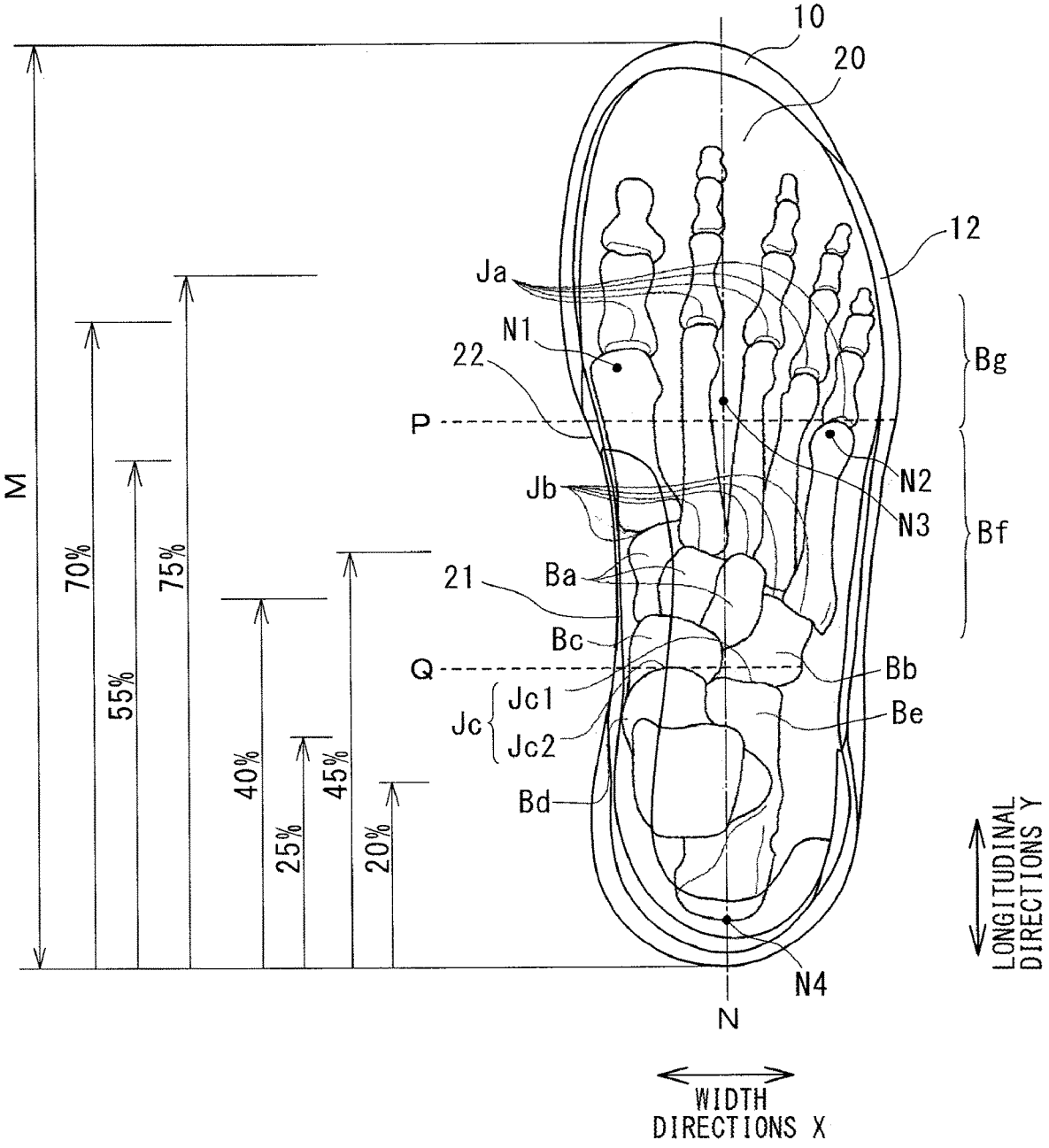
FIG. 2 is a schematic diagram in which a skeleton model of a human foot is superimposed upon a plan view of a shoe sole.

FIG. 2 is a schematic diagram in which a skeleton model of a human foot is superimposed upon a plan view of the shoe sole 1. A human foot is mainly constituted by cuneiform bones Ba, a cuboid bone Bb, a navicular bone Bc, a talus Bd, a calcaneus Be, metatarsal bones Bf, and phalanges Bg. Joints of a foot include MP joints Ja, Lisfranc joints Jb, and a Chopart's joint Jc. The Chopart's joint Jc includes a calcaneocuboid joint Jc1 formed by the cuboid bone Bb and the calcaneus Be, and a talocalcaneonavicular joint Jc2 formed by the navicular bone Bc and the talus Bd.

In the present invention, a center line N of a foot is represented by a straight line connecting a midpoint N3 between the center N1 of the thenar eminence and the center N2 of the hypothenar eminence, and the center N4 of the heel. For example, a longitudinal direction Y is in parallel with the center line N, and a width direction X is perpendicular to the center line N. A line P represents a straight line that extends along a width direction X, which is a direction perpendicular to the center line N, and that is assumed to pass through the heel-side end of the MP joints Ja. Also, a line Q represents a straight line that extends along a width direction X and that is assumed to pass through the toe-side end of the Chopart's joint Jc of the wearer. Hereinafter, a region from the line P to the toe is referred to as a forefoot portion, a region from the line P to the line Q is referred to as a midfoot portion, and a region from the line Q to the heel is referred to as a rearfoot portion. With regard to the relationships between the lines P, Q and the shoe 100, the line P is positioned within a range from 40% to 75% of the entire length M of the shoe 100 from the rear end on the heel side in a direction along the center line N, for example. More preferably, the line P is positioned within a range from 55% to 70% from the rear end. Also, the line Q is positioned within a range from 20% to 45% of the entire length M of the shoe 100 from the rear end on the heel side in a direction along the center line N. More preferably, the line Q is positioned within a range from 25% to 40% from the rear end.

Figure 3:
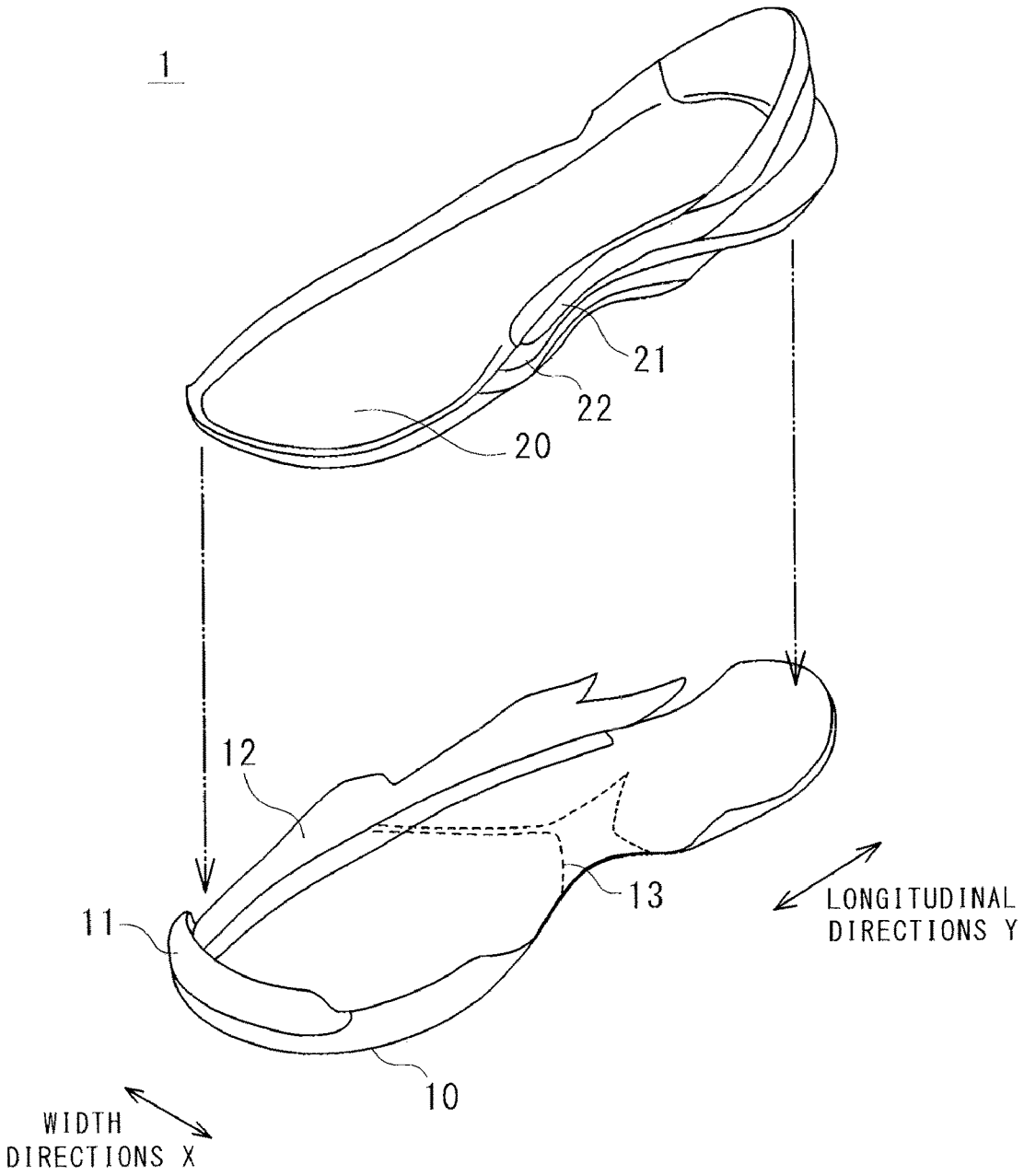
FIG. 3 is an exploded perspective view of the shoe sole.

FIG. 3 is an exploded perspective view of the shoe sole 1. The outer sole 10 includes a bottom surface portion, which comes into contact with a road surface, formed along the entire foot length in a longitudinal direction Y, and also includes a toe protector 11 formed to be curled up to protect the toe. The toe protector 11 extends to a medial part in the forefoot portion, with the height thereof gradually reduced toward the medial part. In a lateral part of the outer sole 10, a lateral reinforcement member 12 formed separately is disposed and joined to the outer sole 10 by means of adhesion or the like.

The lateral reinforcement member 12 is formed to be a wall shape extending from the midfoot portion, which is a middle part in a longitudinal direction Y, to the toe side and the heel side such as to cover the lateral parts of the toe and the heel. As will be described later, the lateral reinforcement member 12 may be integrally formed with the outer sole 10 as long as the lateral reinforcement member 12 has a function to restrain sidewise shifts of a foot. Also, the material of the lateral reinforcement member 12 may be identical with or different from the material of the outer sole 10. The lateral reinforcement member 12 corresponds to a sidewise shift restraining part in the present invention.

The midsole 20 is disposed on the outer sole 10 and formed to reach the toe and the heel. In a medial part of the midsole 20, a medial reinforcement member 21 formed separately is disposed and joined onto the midsole 20 by means of adhesion or the like.

The medial reinforcement member 21 is formed to be a wall shape extending from the midfoot portion, i.e., a middle part in a longitudinal direction Y, to the heel side such as to cover the medial part, rear part, and lateral part of the heel. As will be described later, the medial reinforcement member 21 may be integrally formed with the midsole 20 as long as the medial reinforcement member 21 has a function to restrain upward bending of a heel side part extending from the rear part of the midfoot portion to the heel. Also, the material of the medial reinforcement member 21 may be identical with or different from the material of the midsole 20. The medial reinforcement member 21 corresponds to a bend restraining part in the present invention.

The outer sole 10 may be formed of rubber, a resin, or a composite material of rubber and a resin, for example. The midsole 20 may be formed of resin foam, for example. As a resin, a thermoplastic resin, such as ethylene-vinyl acetate copolymer (EVA), or a thermosetting resin, such as polyurethane (PU), may be used, for example. The resin may contain other arbitrary components, as appropriate. Also, the midsole 20 may be formed of rubber foam, such as butadiene rubber foam. The lateral reinforcement member 12 and the medial reinforcement member 21 may be formed of a non-foamed body or a foamed body of a thermoplastic resin, such as thermoplastic polyurethane (TPU), or a thermosetting resin, such as an epoxy resin, for example. Hardness P2 of the midsole is lower than hardness P1 of the outer sole 10, so that the midsole 20 can be bent more easily than the outer sole 10. Also, hardness P3 of the lateral reinforcement member 12 and hardness P4 of the medial reinforcement member 21 is higher than the hardness P1 of the outer sole 10, so that the lateral reinforcement member 12 and the medial reinforcement member 21 cannot be bent easily, compared to the outer sole 10 and the midsole 20. The materials cited above are intended to be illustrative only, and a material used for each part is not limited thereto.

Figure 4:
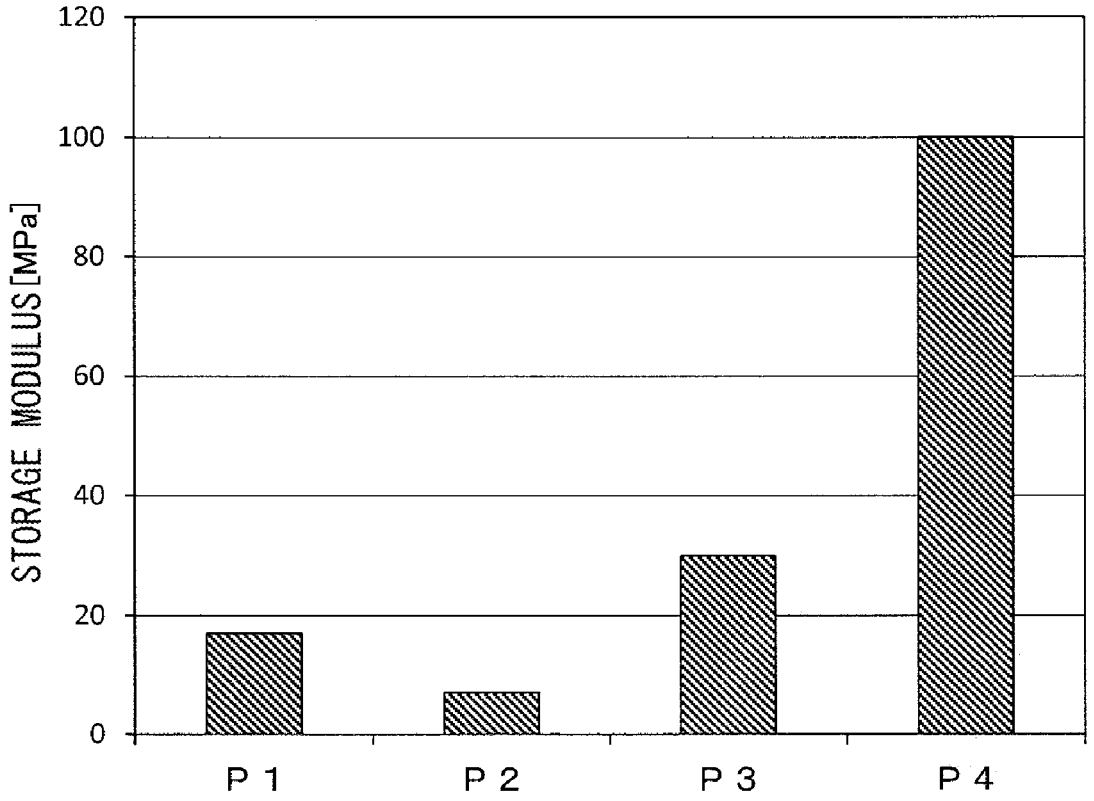
FIG. 4 is a graph that shows an example of an elastic modulus of each portion.

Also, the hardness P4 of the medial reinforcement member 21 is higher than the hardness P3 of the lateral reinforcement member 12, so that the medial reinforcement member 21 cannot be bent easily, compared to the lateral reinforcement member 12. For example, the hardness P1 of the outer sole 10 may be set to HA70, the hardness P2 of the midsole 20 may be set to HC58, the hardness P3 of the lateral reinforcement member 12 may be set to HA75, and the hardness P4 of the medial reinforcement member 21 may be set to HA95. As an index of difficulty of bending, an elastic modulus may also be used. FIG. 4 is a graph that shows an example of an elastic modulus of each portion. FIG. 4 shows a storage modulus (at about 25 degrees C., 10 Hz) of each portion measured by means of a viscoelasticity measuring instrument. For example, as the storage modulus, about 17 MPa for the outer sole 10, about 7 MPa for the midsole 20, about 30 MPa for the lateral reinforcement member 12, and about 100 MPa for the medial reinforcement member 21 may be set. The hardness P3 of the lateral reinforcement member 12 may be made similar to the hardness P4 of the medial reinforcement member 21, and the storage moduli of the lateral reinforcement member 12 and the medial reinforcement member 21 may also be made similar to each other. The values of hardness and storage moduli set forth above are intended to be illustrative only, and each of the values may be set to a different value as long as the magnitude relationships among the respective members are satisfied in terms of the hardness and the storage modulus.

Figure 5:
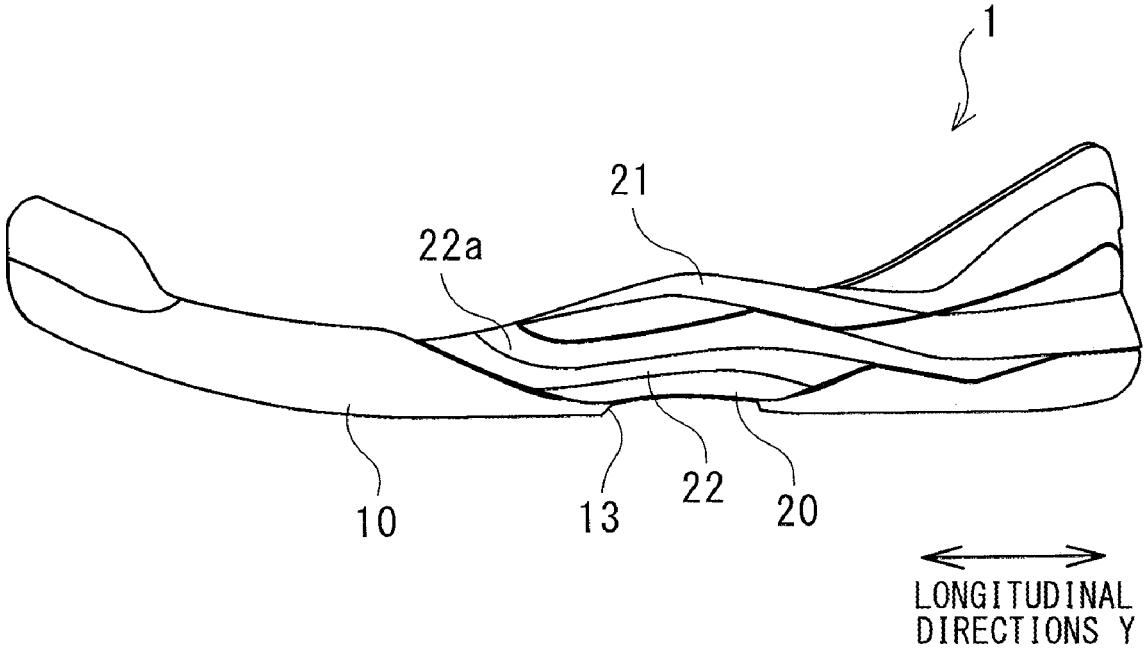
FIG. 5 is a side view that illustrates a medial side of the shoe sole.

FIG. 5 is a side view that illustrates the medial side of the shoe sole 1. In the midsole 20, a portion corresponding to the midfoot portion in the medial part serves as a twist allowance part 22. The twist allowance part 22 includes, in a front side portion thereof, a tilt part 22*a* extending upward from the rear side toward the front side and also extending forward of the medial reinforcement member 21. In the midfoot portion, the medial reinforcement member 21 is disposed on the twist allowance part 22. As described previously, since the medial reinforcement member 21 has high hardness P4 and high rigidity, the medial reinforcement member 21 functions as a portion for restraining upward bending of the heel side of the medial part. Meanwhile, since the twist allowance part 22 has low hardness P2, which is hardness of the midsole 20, and low rigidity, the twist allowance part 22 functions as a portion in which upward bending and medial twisting of the heel side of the medial part are allowed. The rigidity of the twist allowance part 22 may be lowered by forming a groove or thinning the thickness.

Figure 6:
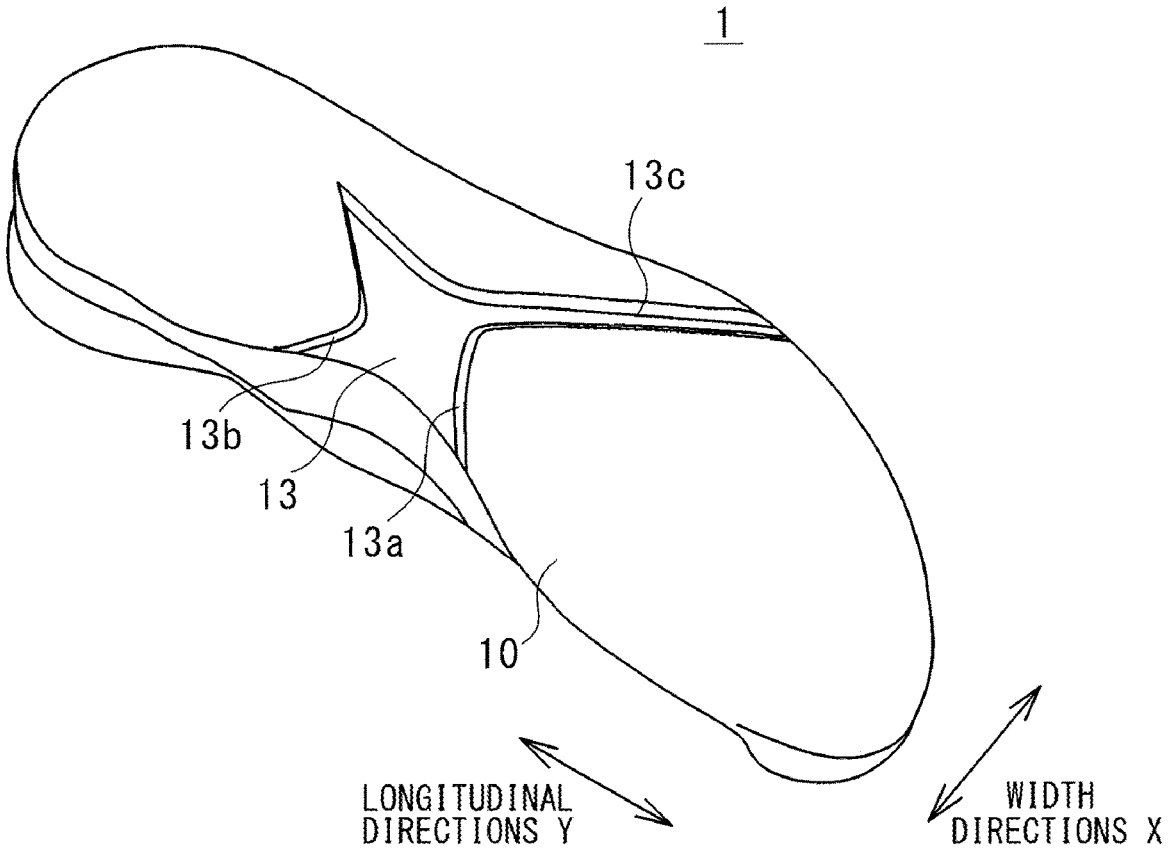
FIG. 6 is a perspective view that illustrates an external view of the bottom surface side of the shoe sole.

Forward of the twist allowance part 22, the medial part of the forefoot portion of the outer sole 10 is formed to be curled up and functions as a portion for restraining a bend in the medial part. In the midfoot portion, i.e., a middle part in a longitudinal direction, of the outer sole 10, a recess 13 is provided such as to hole the bottom surface side. FIG. 6 is a perspective view that illustrates an external view of the bottom surface side of the shoe sole 1. With regard to the recess 13, the medial part is open, and a front edge 13*a* is parallel with a width direction X or slightly tilted rearward from the medial part toward the lateral part. A rear edge 13*b* of the recess 13 is tilted forward from the medial part toward the lateral part and, from a middle part, tilted rearward inversely. The recess 13 is provided to reach a middle part (nearly the center) in a width direction X of the shoe sole 1 and, from an edge part on the lateral side of the front edge 13*a*, the recess 13 continues to a groove 13*c*. The thickness of the outer sole 10 becomes smaller in the recess 13, which functions as a portion in which upward bending and medial twisting of the heel side are allowed.

Figure 7:
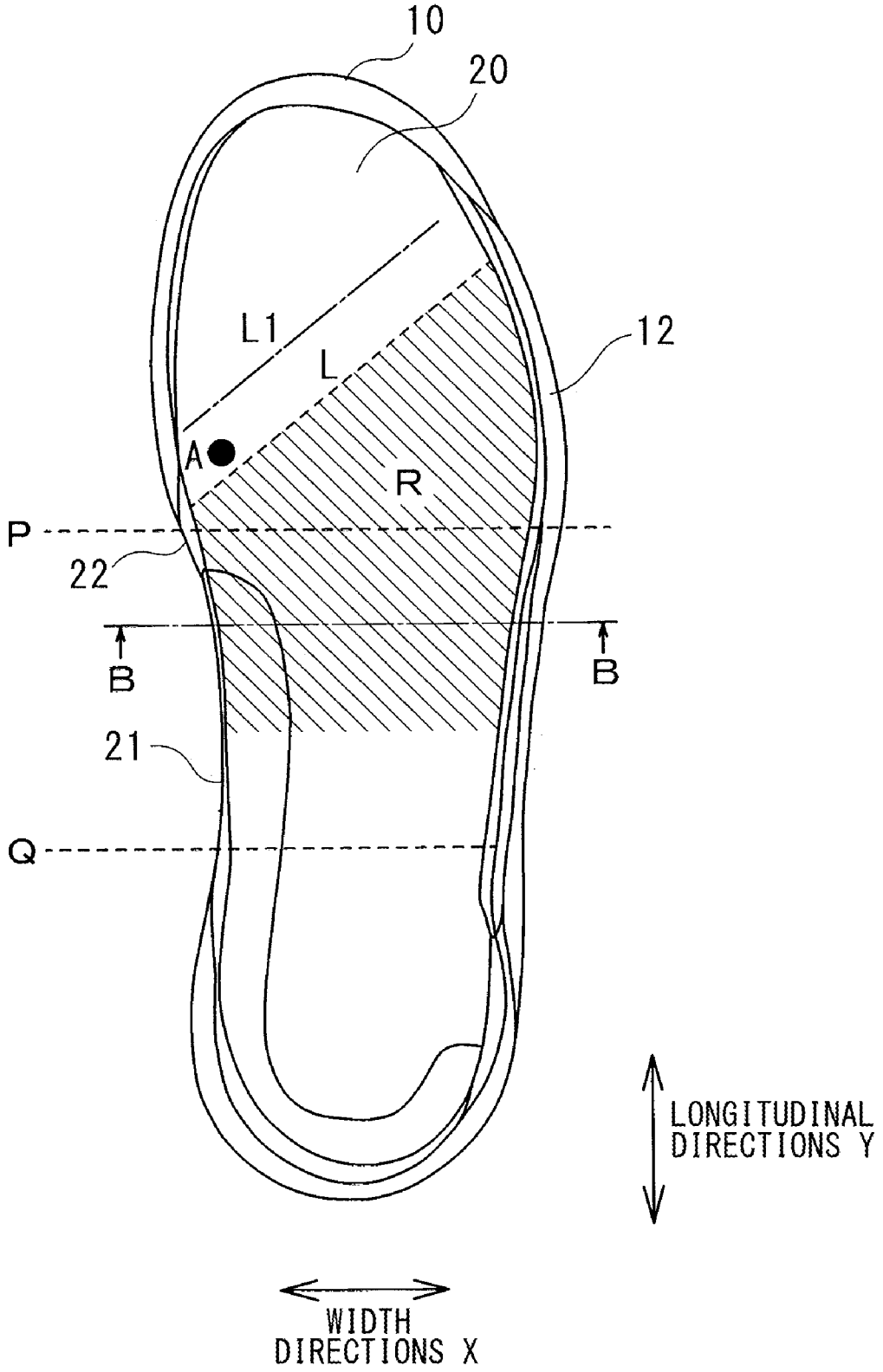
FIG. 7 is a schematic diagram used to describe bending of the shoe sole during a turning motion.
Figure 8:
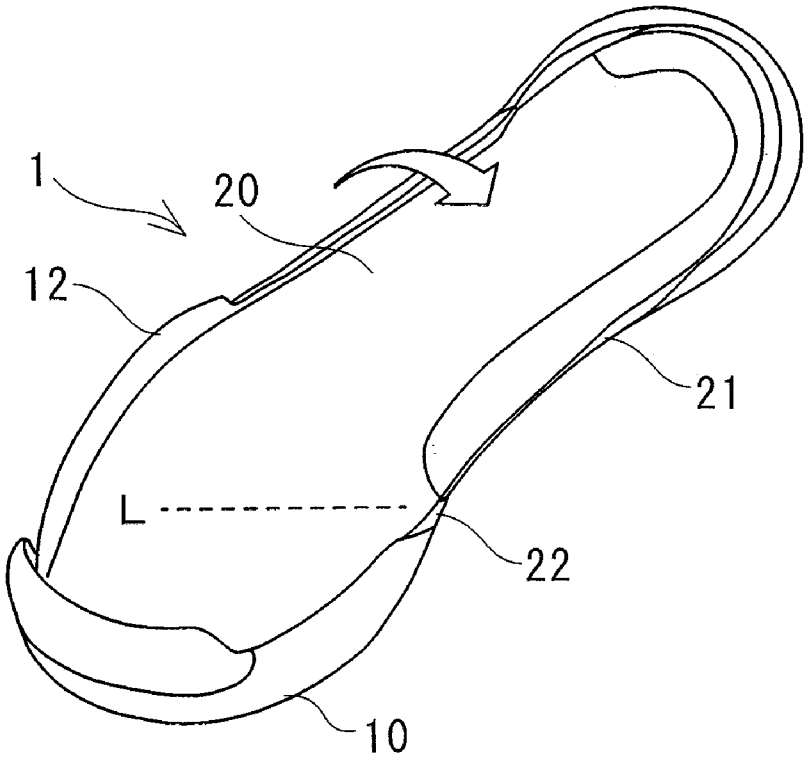
FIG. 8 is a schematic diagram that illustrates a deformed state of the shoe sole during a turning motion.

There will now be described the functions of the shoe 100. FIG. 7 is a schematic diagram used to describe bending of the shoe sole 1 during a turning motion, and FIG. 8 is a schematic diagram that illustrates a deformed state of the shoe sole 1 during a turning motion. In a turning motion, a person moves the body to one of left and right sides and then quickly returns to the original position, so that the person may be in a posture of supporting the weight shift to the side while the vicinity of the thenar eminence of the foot extending to the side is in contact with the ground and the heel is raised. At the time, the foot is placed in a state where the portion positioned rearward of the thenar eminence is medially twisted with respect to the toe side.

A position A shown in FIG. 7 indicates the position of the thenar eminence. Also, a line L represents a line tilted forward from a position in the rear of the position A of the thenar eminence in the medial part toward the lateral part. During a turning motion, a portion positioned forward of the line L is in contact with the ground, and a portion positioned rearward of the line L is medially twisted.

The tilt angle of the line L is assumed to be about 45 degrees, for example, with respect to a width direction X. Because of individual differences in turning motions and the like, the tilt angle of the line L may be different. Also, the line L need not necessarily be positioned strictly rearward of the position A of the thenar eminence in the medial part. For example, as indicated by a dashed dotted line L1 in FIG. 7, the line L may be positioned forward of the position A of the thenar eminence in the medial part.

A region R hatched with diagonal lines in FIG. 7 indicates a portion in which upward bending and medial twisting of the heel side are allowed in the shoe sole 1. As described previously, the twist allowance part 22 is formed in the midfoot portion in the medial part of the shoe sole 1. The twist allowance part 22 is bent and deformed such as to follow the medial twisting of the portion positioned rearward of the thenar eminence in the midfoot portion in the medial part of the shoe sole 1, so that the capability to follow twisting of a foot during a turning motion can be improved. Also, since the twist allowance part 22 is provided integrally with the midsole 20, another member need not be prepared or joined to form the twist allowance part 22, so that the manufacturability of the shoe 100 can be improved.

As illustrated in FIG. 5, the twist allowance part 22 includes, in the front side portion thereof, the tilt part 22*a* extending upward from the rear side toward the front side and also extending forward of the medial reinforcement member 21. With the tilt part 22*a*, deformation due to a twist in the upper part caused by deformation at the line L shown in FIG. 7 can also be allowed. The tilt part 22*a* provides an effect of increasing the capability to follow the medial twisting of the portion positioned rearward of the thenar eminence in the midfoot portion in the medial part of the shoe sole 1.

Figure 9:
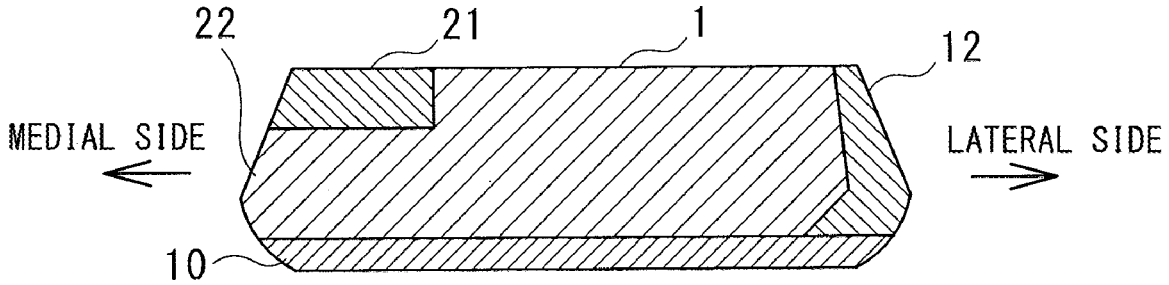
FIG. 9 is a schematic diagram used to describe rigidity in a cross section of the shoe sole taken along line B-B in FIG. 7.

FIG. 9 is a schematic diagram used to describe rigidity in a cross section of the shoe sole 1 taken along line B-B in FIG. 7. As described above, the twist allowance part 22 is provided in the medial part of the shoe sole 1, so that the capability to follow a turning motion can be improved. Also, the lateral reinforcement member 12 is provided in the lateral part of the shoe sole 1, and, by setting the hardness P3 of the lateral reinforcement member 12 higher, sidewise shifts of a foot can be restrained.

As long as the rigidity in a cross section of the midfoot portion is distributed as illustrated in FIG. 9, the capability to follow a turning motion can be improved. Accordingly, the shoe sole 1 to which the present invention is applied is not limited to a configuration constituted by the outer sole 10 and the midsole 20. For example, the outer sole 10 may be divided between the forefoot portion and the rearfoot portion.

Also, the twist allowance part 22 formed with the midsole 20 may be included in the midsole 20, or may be configured separately from the midsole 20. Further, even if the shoe sole 1 is configured not to include the midsole 20 extending from the toe to the heel, as long as a portion corresponding to the twist allowance part 22 is provided in the medial part of the shoe sole 1, the capability to follow a turning motion can be improved.

Figure 10:
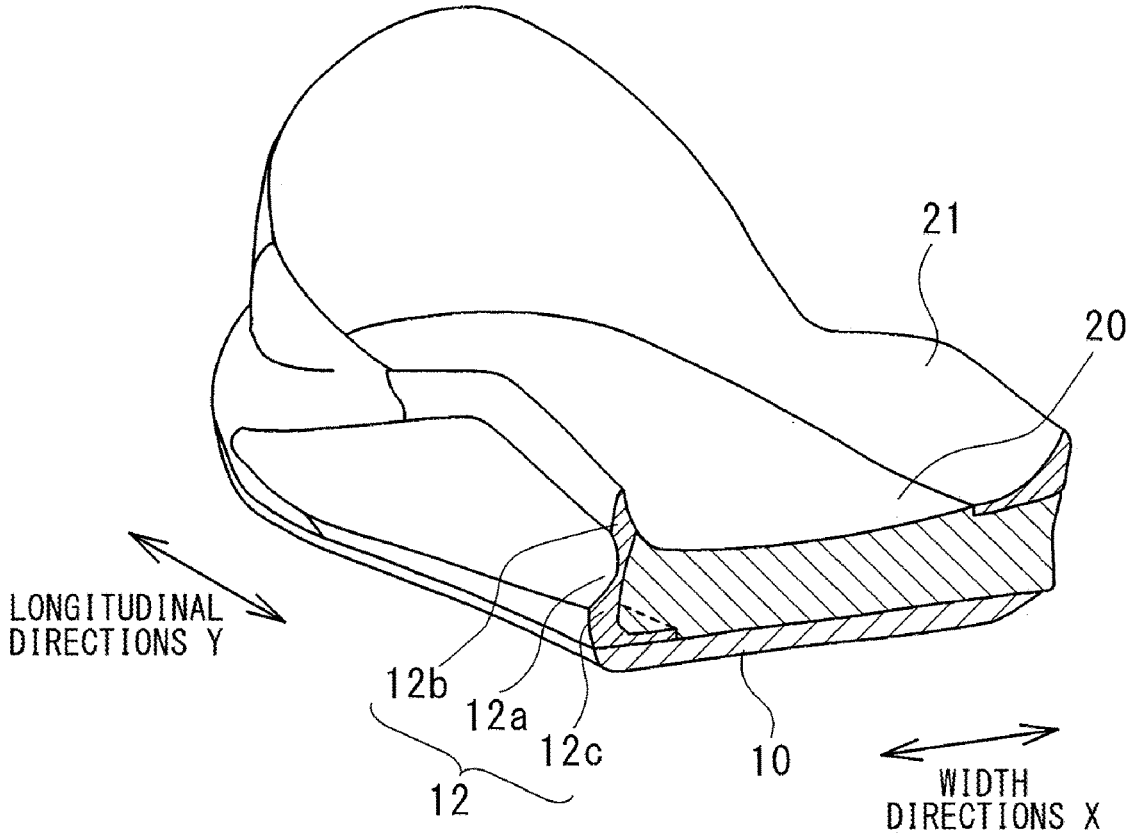
FIG. 10 is a perspective view of the shoe sole cut along a cross section perpendicular to a longitudinal direction Y in a midfoot portion.

The lateral reinforcement member 12 extends from the midfoot portion, which is a middle part in a longitudinal direction Y, to the toe side such as to cover the lateral part of the toe, thereby restraining sidewise shifts of a toe portion of the foot. The lateral reinforcement member 12 also extends from the midfoot portion to the heel side such as to cover the lateral part of the heel, thereby restraining sidewise shifts of a heel portion of the foot. The lateral reinforcement member 12 need not necessarily extend to the toe side and the heel side. FIG. 10 is a perspective view of the shoe sole 1 cut along a cross section perpendicular to a longitudinal direction Y in the midfoot portion. FIG. 10 is a perspective view from the lateral side of the shoe sole 1. On the cross section of the lateral reinforcement member 12 illustrated in FIG. 10, a recess part 12*a*, which is recessed with respect to the lateral direction in a middle part in a vertical direction, is formed to extend at least from the midfoot portion to the rearfoot portion. On the upper side of the recess part 12*a*, an upper edge part 12*b* is formed, and, on the lower side of the recess part 12*a*, a lower edge part 12*c* is formed. The upper edge part 12*b* and the lower edge part 12*c* are thicker in a width direction X than the bottom of the recess part 12*a*, so that the bending rigidity of the lateral reinforcement member 12 against bending deformation with the heel side raised can be improved. Also, since the upper edge part 12*b* is thicker in a width direction X than the bottom of the recess part 12*a*, the body weight applied to the lateral side of the foot can be strongly supported, so that a stable turning motion can be smoothly performed.

The medial reinforcement member 21 is disposed on the twist allowance part 22. The medial reinforcement member 21 restrains upward bending deformation of the heel side in the twist allowance part 22 and maintains high rigidity in a portion from the rear part of the midfoot portion to the heel side. Also, the medial reinforcement member 21 extends from the midfoot portion, i.e., a middle part in a longitudinal direction Y, to the heel side such as to cover the medial part, rear part, and lateral part of the heel, enabling favorable support for rotation about a vertical axis when the heel is raised. The medial reinforcement member 21 need not necessarily include the portion that covers the medial part, rear part, and lateral part of the heel.

The outer sole 10 includes the recess 13 provided such as to hole the bottom surface side, in the midfoot portion, i.e., a middle part in a longitudinal direction. The thickness of the outer sole 10 becomes smaller in the recess 13. Since the rigidity in the midfoot portion is lowered by the recess 13, the capability to follow a turning motion can be improved. Also, in a width direction X, the medial side of the recess 13 is open, and the recess 13 is provided to reach a middle part in a width direction X. Accordingly, the recess 13 is deformed in response to deformation of the medial part caused by twisting deformation during a turning motion, and, on the lateral part of the shoe sole 1, the effect of restraining bending deformation can be obtained.

Modifications

Figure 11A:
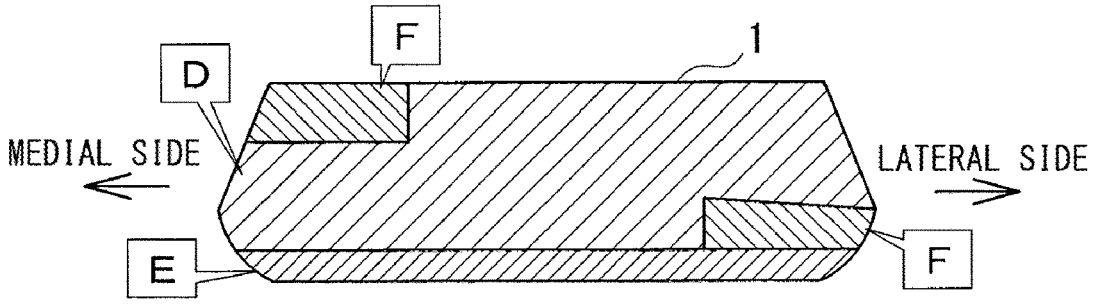
FIGS. 11A, 11B and 11C are schematic diagrams used to describe rigidity in a cross section of a shoe sole according to modifications.
Figure 11B:
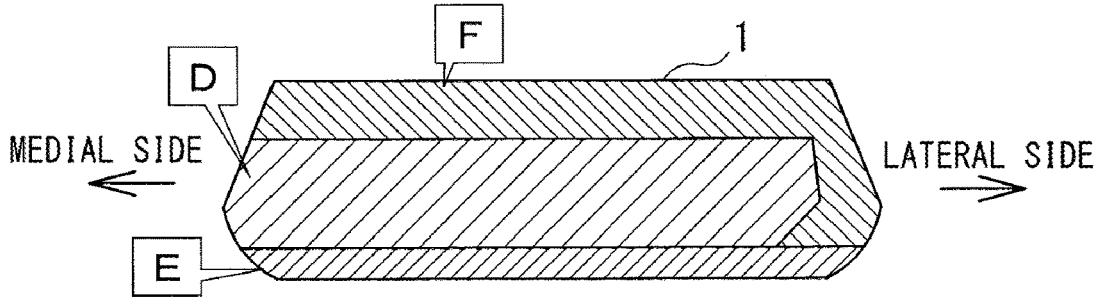
Figure 11C:
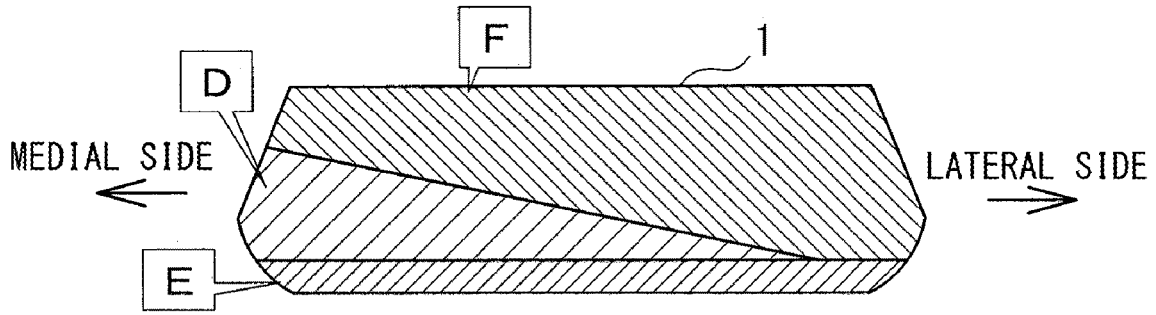

FIGS. 11A, 11B and 11C are schematic diagrams used to describe rigidity in a cross section of the shoe sole 1 according to modifications. Each of FIGS. 11A, 11B and 11C schematically illustrates the cross section taken along line B-B in FIG. 7, and D denotes a low rigidity portion, E denotes a middle rigidity portion, and F denotes a high rigidity portion.

Similarly to the case described with reference to FIG. 9, as long as the rigidity in a cross section of the midfoot portion is distributed as illustrated in FIGS. 11A, 11B and 11C, the capability to follow a turning motion can be improved, and the shoe sole 1 is not limited to the configuration constituted by the outer sole 10 and the midsole 20.

In the example illustrated in FIG. 11A, the rigidity distribution in the medial part of the shoe sole 1 is similar to that in the aforementioned first embodiment. In the lateral part of the shoe sole 1, a high rigidity portion is provided in a lower part, and a low rigidity portion is provided thereon. In this example, the effect of restraining sidewise shifts of a foot is reduced compared to the first embodiment. However, bending deformation is easily enabled also in the lateral part of the shoe sole 1, so that the capability to follow the medial twisting of the portion positioned rearward of the thenar eminence can be increased.

In the example illustrated in FIG. 11B, the rigidity distribution in the medial part and the lateral part of the shoe sole 1 is similar to that in the aforementioned first embodiment; however, the high rigidity portions in the medial part and the lateral part are continuously formed. Continuously providing the high rigidity portions in the medial part and the lateral part of the shoe sole 1 increases the strength, which is suitable for the case where a greater load is applied to the foot and turning motions are frequently performed.

In the example illustrated in FIG. 11C, the high rigidity portions in the medial part and the lateral part are continuously formed, as in the case of the example illustrated in FIG. 11B; however, the high rigidity portions also include a region from an upper part of the medial part to the lower part of the lateral part. In the example illustrated in FIG. 11C, by further increasing the region occupied by the high rigidity portions compared to the example illustrated in FIG. 11B, the strength can be further increased.

Figure 12A:
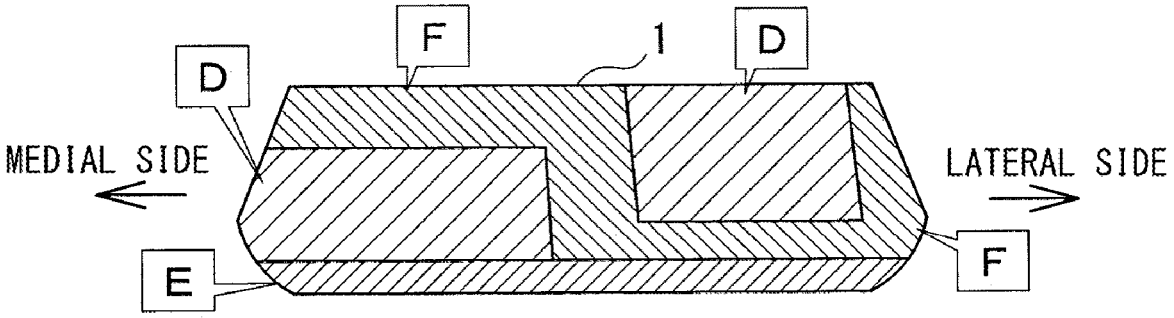
FIGS. 12A, 12B and 12C are schematic diagrams used to describe rigidity in a cross section of a shoe sole according to other modifications.
Figure 12B:
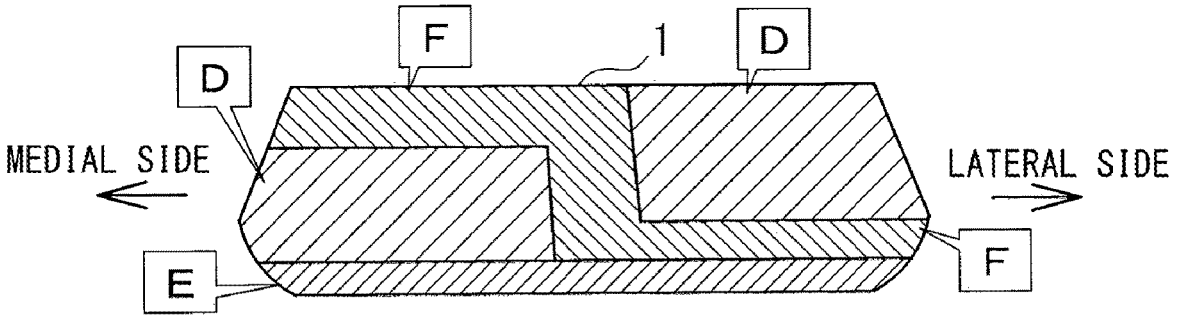
Figure 12C:
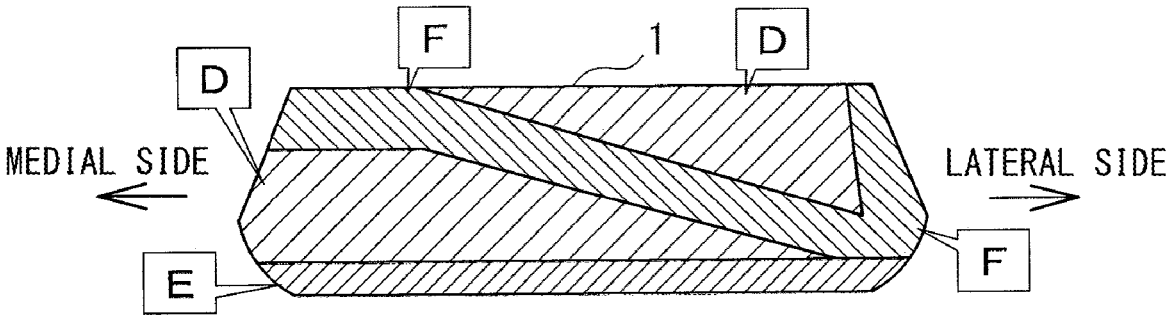

FIGS. 12A, 12B and 12C are schematic diagrams used to describe rigidity in a cross section of the shoe sole 1 according to other modifications. Each of FIGS. 12A, 12B and 12C schematically illustrates the cross section taken along line B-B in FIG. 7, and D denotes a low rigidity portion, E denotes a middle rigidity portion, and F denotes a high rigidity portion.

Similarly to the case described with reference to FIG. 9, as long as the rigidity in a cross section of the midfoot portion is distributed as illustrated in FIGS. 12A, 12B and 12C, the capability to follow a turning motion can be improved, and the shoe sole 1 is not limited to the configuration constituted by the outer sole 10 and the midsole 20.

In the example illustrated in FIG. 12A, the rigidity distribution in the medial part and the lateral part of the shoe sole 1 is similar to that in the aforementioned first embodiment. The high rigidity portion in the medial part extends to the lateral side and, from a middle part, extends toward the lower part. In the lower part, the high rigidity portion continues to the high rigidity portion in the lateral part. Since the rigidity distribution in the medial part and the lateral part of the shoe sole 1 is similar to that in the aforementioned first embodiment, the capability to follow a turning motion is improved, and the effect of restraining sidewise shifts of a foot can be obtained. Also, since the high rigidity portions in the medial part and the lateral part are continuously formed, the strength of the shoe sole 1 can be increased.

In the example illustrated in FIG. 12B, the rigidity distribution in the medial part of the shoe sole 1 is similar to that in the aforementioned first embodiment; however, in the lateral part of the shoe sole 1, a high rigidity portion is provided in a lower part, and a low rigidity portion is provided thereon. The high rigidity portion extends from the medial part to the lateral side in the shoe sole 1 and, from a middle part, extends toward the lower part. In the lower part, the high rigidity portion continues to the high rigidity portion in the lateral part. With this configuration, improved capability to follow a turning motion and improved strength of the shoe sole 1 can be expected.

In the example illustrated in FIG. 12C, the high rigidity portions in the medial part and the lateral part are continuously formed, as in the case of the example illustrated in FIG. 12A; however, the high rigidity portions are provided continuously to be tilted from the upper part of the medial part toward the lower part of the lateral part. In this example, improved capability to follow a turning motion, restrained sidewise shifts of a foot, and improved strength of the shoe sole 1 can be expected.

There will now be described the features of the shoe 100 according to the embodiment and the modifications.

The shoe 100 includes the twist allowance part 22 and the medial reinforcement member 21 (bend restraining part). The twist allowance part 22 is provided in the medial part of the midfoot portion in the shoe sole 1 serving as a bottom portion and allows medial twisting of the heel side with respect to the toe side. The medial reinforcement member 21 is disposed on the twist allowance part 22 and restrains upward bending of the heel side in the medial part. Accordingly, the shoe 100 has favorable capability to follow twisting of a foot during a turning motion.

The shoe 100 also includes the lateral reinforcement member 12 (sidewise shift restraining part) provided in the lateral part of the shoe sole 1, and the lateral reinforcement member 12 has higher hardness than the twist allowance part 22. Accordingly, the shoe 100 can restrain sidewise shifts of a foot, while maintaining the capability to follow the twisting of a foot.

The lateral reinforcement member 12 is provided to extend from a middle part in a longitudinal direction to the lateral part of the toe. Accordingly, the shoe 100 can restrain sidewise shifts of a toe portion of a foot.

Also, the medial reinforcement member 21 is provided to extend from a middle part in a longitudinal direction to a heel portion. Accordingly, the shoe 100 enables favorable support for rotation about a vertical axis when the heel is raised.

The twist allowance part 22 includes, in the front side portion thereof, the tilt part 22*a* extending upward from the rear side toward the front side. The tilt part 22*a* also extends forward of the medial reinforcement member 21. Accordingly, the shoe 100 has further favorable capability to follow twisting of a foot during a turning motion.

The shoe sole 1 includes the outer sole 10 that comes into contact with a road surface, and the midsole 20 disposed on the outer sole 10. The twist allowance part 22 is formed in the medial part of the midsole 20. Accordingly, since the twist allowance part 22 is provided integrally with the midsole 20 in the shoe 100, another member need not be prepared or joined to form the twist allowance part 22, so that the manufacturability of the shoe 100 can be improved.

In a middle part in a longitudinal direction of the outer sole 10, the recess 13 is provided such as to hole the bottom surface side. Since the recess 13 provided in the outer sole 10 produces an effect of allowing a twist, the shoe 100 has further favorable capability to follow twisting of a foot during a turning motion.

The present invention has been described with reference to an embodiment. The embodiment is intended to be illustrative only, and it will be obvious to those skilled in the art that various modifications and changes could be developed within the scope of claims of the present invention and that such modifications and changes also fall within the scope of claims of the present invention. Therefore, the description in the present specification and the drawings should be regarded as exemplary rather than limitative.

DESCRIPTION OF THE REFERENCE NUMERALS

1 shoe sole (bottom portion), 10 outer sole, 12 lateral reinforcement member (sidewise shift restraining part), 20 midsole, 21 medial reinforcement member (bend restraining part), 22 twist allowance part, 22*a* tilt part, 100 shoe

INDUSTRIAL APPLICABILITY

The present invention relates to a shoe.

The invention claimed is:

1. A shoe, comprising:

a twist allowance part that is provided in a medial part of a midfoot portion in a bottom portion and that allows medial twisting of a heel side with respect to a toe side;

a medial reinforcement member that is disposed on the twist allowance part and that restrains upward bending of the heel side in the medial part, the medial reinforcement member and the twist allowance part extending to form at least a portion of a medial side exterior outer edge of the shoe; and an outer sole in the bottom portion, wherein at least part of the twist allowance part in the medial part is positioned between the medial reinforcement member and the outer sole;

wherein the twist allowance part includes, in a front side portion thereof, a tilt part extending upward from a rear side toward a front side, the tilt part extending to form a portion of the medial side exterior outer edge of the shoe;

wherein the tilt part extends forward of the medial reinforcement member at the medial side exterior outer edge of the shoe;

wherein the medial reinforcement member extends directly above the twist allowance part, the medial reinforcement member including a bottom surface that overlaps an upper surface of the twist allowance part; and wherein the twist allowance part has a lower hardness than the medial reinforcement member.

2. The shoe according to claim 1, further comprising a lateral reinforcement member that is provided in a lateral part of the bottom portion and that has a higher hardness than the twist allowance part, wherein the lateral reinforcement member extends to form at least a portion of a lateral side exterior outer edge of the shoe.

3. The shoe according to claim 2, wherein the lateral reinforcement member is provided to extend from a middle part in a longitudinal direction to the lateral part of the toe side.

4. The shoe according to claim 3, wherein the medial reinforcement member is provided to extend from the midfoot portion on the medial side exterior outer edge around the heel side at a rear of the shoe.

5. The shoe according to claim 4, wherein:

the bottom portion includes a midsole and the outer sole, wherein the outer sole is configured to come into contact with a road surface; and the twist allowance part is formed in a medial part of the midsole.

6. The shoe according to claim 3, wherein:

the bottom portion includes a midsole and the outer sole, wherein the outer sole is configured to come into contact with a road surface; and the twist allowance part is formed in a medial part of the midsole.

7. The shoe according to claim 2, wherein the medial reinforcement member is provided to extend from the midfoot portion on the medial side exterior outer edge around the heel side at a rear of the shoe.

8. The shoe according to claim 7, wherein:

the bottom portion includes a midsole and the outer sole, wherein the outer sole is configured to come into contact with a road surface; and the twist allowance part is formed in a medial part of the midsole.

9. The shoe according to claim 2, wherein:

the bottom portion includes a midsole and the outer sole, wherein the outer sole is configured to come into contact with a road surface; and the twist allowance part is formed in a medial part of the midsole.

10. The shoe according to claim 2, wherein the lateral reinforcement member has a lower hardness than the medial reinforcement member.

11. The shoe according to claim 1, wherein the medial reinforcement member is provided to extend from a middle part in a longitudinal direction to a heel portion.

12. The shoe according to claim 11, wherein:

the bottom portion includes a midsole and the outer sole, wherein the outer sole is configured to come into contact with a road surface; and the twist allowance part is formed in a medial part of the midsole.

13. The shoe according to claim 1, wherein:

the bottom portion includes a midsole and the outer sole, wherein the outer sole is configured to come into contact with a road surface; and the twist allowance part is formed in a medial part of the midsole.

14. The shoe according to claim 13, wherein, in a middle part in a longitudinal direction of the outer sole, a recess is provided to form a hole on a bottom surface side.

15. A shoe comprising:

a midsole;

an outer sole configured to come into contact with a surface, the outer sole coupled to the midsole; and a medial reinforcement member positioned on the midsole on a medial portion of the midsole, the medial reinforcement member extending to a medial side exterior outer edge of the shoe, the medial reinforcement member including a bottom surface that overlaps an upper surface of the midsole on the medial portion of the midsole, the medial reinforcement member having a hardness greater than the medial portion of the midsole that is overlapped by the medial reinforcement member;

wherein at least part of the medial portion of the midsole is positioned between the medial reinforcement member and the outer sole.

16. The shoe according to claim 15, wherein a part of the medial portion of the midsole extends upward from a rear side toward a front side and extends forward of the medial reinforcement member.

17. The shoe according to claim 16, further comprising a lateral reinforcement member, wherein the lateral reinforcement member extending to a lateral side exterior outer edge of the shoe, the lateral reinforcement member having a higher hardness than a lateral portion of the midsole.

18. The shoe according to claim 17, wherein the medial reinforcement member has a higher hardness than the lateral reinforcement member.

19. The shoe according to claim 18, wherein the outer sole has a lower hardness than the lateral reinforcement member and a higher hardness than the midsole.

20. The shoe according to claim 19, further comprising an upper coupled to the midsole.

* * * * *